US010046247B2

(12) United States Patent
Huang

(10) Patent No.: US 10,046,247 B2
(45) **Date of Patent: *Aug. 14, 2018**

(54) TRANSFERABLE POWER UNIT SYSTEM FOR TOYS

(71) Applicant: RAZOR USA LLC, Cerritos, CA (US)

(72) Inventor: Joey Chih-Wei Huang, Temple City, CA (US)

(73) Assignee: Razor USA LLC, Cerritos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/297,559

(22) Filed: Oct. 19, 2016

(65) Prior Publication Data

US 2017/0136377 A1 May 18, 2017

Related U.S. Application Data

(63) Continuation of application No. 14/539,161, filed on Nov. 12, 2014, now Pat. No. 9,474,985.

(60) Provisional application No. 61/904,373, filed on Nov. 14, 2013.

(51) Int. Cl.

| | |
|---|---|
| ***A63H 29/00*** | (2006.01) |
| ***A63H 29/24*** | (2006.01) |
| ***A63H 17/00*** | (2006.01) |
| ***A63H 27/00*** | (2006.01) |
| ***A63H 29/22*** | (2006.01) |
| ***A63H 1/06*** | (2006.01) |

(52) U.S. Cl.

CPC ..... *A63H 29/24* (2013.01); *A63H 1/06* (2013.01); *A63H 17/00* (2013.01); *A63H 27/00* (2013.01); *A63H 29/22* (2013.01)

(58) Field of Classification Search

USPC ... 446/57, 58, 90, 91, 93–95, 102, 103, 431, 446/434, 436, 448, 457, 461, 462, 465, 446/470, 471

See application file for complete search history.

(56) References Cited

U.S. PATENT DOCUMENTS

| | | | |
|---|---|---|---|
| 3,956,378 | A | 5/1976 | Grasselli et al. |
| 4,406,085 | A | 9/1983 | Rhodes |
| 4,878,877 | A | 11/1989 | Auer et al. |
| 4,889,516 | A | 12/1989 | Auer et al. |

(Continued)

FOREIGN PATENT DOCUMENTS

| | | |
|---|---|---|
| CN | 203 139 632 | 8/2013 |
| DE | 198 20 701 | 11/1999 |

(Continued)

OTHER PUBLICATIONS

International Search Report and Written Opinion in corresponding International Patent Application No. PCT/US2014/065482, dated May 19, 2015, in 16 pages.

(Continued)

*Primary Examiner* — Kurt Fernstrom

(74) *Attorney, Agent, or Firm* — Knobbe Martens Olson & Bear, LLP

(57) ABSTRACT

A power unit for a toy or a system of toys that can removable receive the power unit. The power unit comprises a drive gear that can provide rotational power to one or more driven components of a toy with which the power unit is associated. The drive gear can comprise multiple drive portions. The toys can comprise a wide variety of toy types.

13 Claims, 18 Drawing Sheets

(56) References Cited

U.S. PATENT DOCUMENTS

| | | | | |
|---|---|---|---|---|
| 5,090,934 | A | 2/1992 | Quercetti | |
| 5,135,428 | A | 8/1992 | Shibayama | |
| 5,411,428 | A | 5/1995 | Orii et al. | |
| 6,659,837 | B1 * | 12/2003 | Lieberman | A63H 17/262 446/220 |
| 6,971,941 | B2 | 12/2005 | Kaneko et al. | |
| 7,568,962 | B2 | 8/2009 | Amadio et al. | |
| 7,789,728 | B2 * | 9/2010 | Friedman | A63H 17/26 446/217 |
| 8,260,459 | B2 | 9/2012 | Herbert et al. | |
| 8,435,094 | B2 | 5/2013 | Amadio et al. | |
| 8,562,386 | B2 * | 10/2013 | Carlson | A63H 17/26 446/431 |
| 8,579,671 | B2 | 11/2013 | DeRennaus et al. | |
| 9,474,985 | B2 | 10/2016 | Huang | |
| 2011/0104982 | A1 * | 5/2011 | Koehl | A63H 17/262 446/465 |
| 2015/0140895 | A1 | 5/2015 | Huang | |

FOREIGN PATENT DOCUMENTS

| | | |
|---|---|---|
| GB | 1 303 241 | 1/1973 |
| WO | WO 03/092844 | 11/2003 |

OTHER PUBLICATIONS

International Preliminary Report on Patentability in corresponding International Patent Application No. PCT/US2014/065482, dated May 26, 2016, in 10 pages.

* cited by examiner

TRANSFERABLE POWER UNIT SYSTEM FOR TOYS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

Embodiments of the invention relate generally to a toy having a removable power unit or a system of toys incorporating an interchangeable and transferable power unit to power various toys of the system.

Description of the Related Art

Toys for children sometimes have moving components, such as a toy car with spinning wheels or a toy helicopter with spinning propellers, for example. With the advent of smaller motors and cost efficient batteries, children's toys have more recently incorporated small motors and batteries to allow for automated movement and/or rotation of the toys, or components thereof. For example, a simple toy car may include a small motor and battery to power the rotation of the wheels, or a toy robot may include a small motor and battery to power a spinning robot component.

SUMMARY

However, these traditional motorized children's toys include a motor and battery encapsulated within the toy, such that the motor and battery must be configured specifically for that toy configuration, and is limited to its use in that specific toy only. This increases cost for the manufacturer by requiring a motor mechanism to be installed into each toy. In addition, this further increases the cost for the consumer who is forced to purchase multiple toys, even though sometimes the only substantial difference is the outer toy shell appearance, while incorporating the same or substantially the same interior motor and power source configuration.

Therefore, what is needed is a toy with a replaceable power unit comprising a battery and, preferably, a motor and/or a system of toys having a transferable power unit which allows for the removable and interchangeable power unit to be compatible with different toys of the system. The power unit can also comprise a controller that controls operation of the battery, motor or components of an associated toy. The power unit can also comprise a multi-component drive arrangement that is capable of driving multiple types of driven components, such as different types of gears or driven elements, which can include multiple directions of movement.

The systems, methods and devices described herein have innovative aspects, no single one of which is indispensable or solely responsible for their desirable attributes. Without limiting the scope of the claims, some of the advantageous features will now be summarized.

An aspect of the present disclosure involves a system for children's toys including a removable and interchangeable power unit, and children's toy components configured to receive the removable and interchangeable power units. The system may include children's toys which may include one or several components of a toy configured to be moved or rotated by a motor. A body of the toy may include a void configured to receive and, possibly, retain a removable and interchangeable power unit (hereinafter referred to as a "power unit"), and components of the toy body may be configured to be in mechanical or electrical communication with components of the power unit once the power unit is inserted into the toy body. The system may include several different types, styles, and sizes of toy bodies, but a plurality or an entirety of the toy bodies of the current system may be configured to receive and cooperate with the same power unit configuration.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
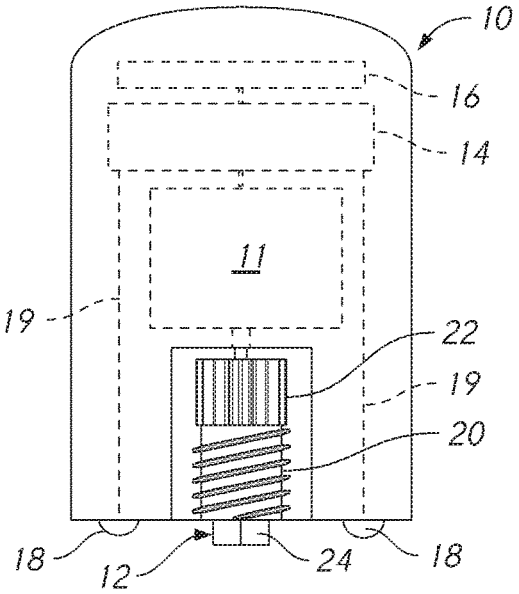
FIG. 1 illustrates a power unit having certain features, aspects and advantages of an embodiment. Features illustrated in dashed line indicate that such features are enclosed within an outer housing or body of the power unit.

Reference will now be made in detail to some embodiments of the present technology. While numerous specific embodiments of the present technology will be described in conjunction with alternative embodiments, it will be understood that the disclosure of particular embodiments is not intended to limit the present technology to these embodiments. On the contrary, it is also intended that the disclosure cover alternatives, modifications, and equivalents of the particular embodiments. Furthermore, in the following detailed description, numerous specific details are set forth in order to provide a thorough understanding of the present technology. However, it will be recognized by those of ordinary skill in the art that embodiments may be practiced without these specific details. In other instances, well known methods, procedures, components, compositions, and mechanisms have not been described in detail as not to unnecessarily obscure aspects of embodiments of the present technology.

Embodiments of the transferable power unit system for toys may be configured to allow a user to insert a power unit into a children's toy configured to be moved or otherwise activated by a motor. The power unit may include a small motor and/or a power source, such as a battery, to provide power to the motor. The motor may be attached to a drive arrangement, such as a drive gear or a drive shaft, configured to transfer torque or power to a corresponding driven gear or other driven member of another component of the system. The system may also include children's toys (hereinafter referred to as a "toy body") which may include a void configured to receive a power unit. The toy body may include, for example, any components of a traditional children's toy, such as wheels and axles for toy vehicles, or any other components or features that can be moved or otherwise activated by the power unit. The toy body may be configured receive and secure a power unit, and the toy body may further include a driven gear, driven socket or other driven member configured to receive rotational or other power transferred from the power unit inserted into the toy body. The components of the toy body may be configured such that that rotational or other power transferred from the power unit to the driven gear or driven socket of the toy body is translated into movement or other activation of one or more components of the toy body, thereby creating movement or other activation of the toy.

In some embodiments, the transferable power unit may be configured to include a power source and a motor, and the motor may be operably connected to a propulsion mechanism such as a wheel. In such embodiments, the toy body may be configured to receive and secure the transferable power unit such that the drive or propulsion mechanism of the transferable power unit provides forward propulsion for the toy body. In such embodiments, all components involved in the propulsion of the toy body except for a final drive may be included within the transferable power unit. Alternatively, some components involved in the propulsion of the toy body can be provided in the transferable power unit and some components can be provided in the toy body.

In other embodiments, the toy body may include components of a traditional children's toy, and may further include the motor (and possibly other components, such as a transmission or other drive arrangement) configured to drive said components. The transferable power unit may include a power source such as a rechargeable battery or capacitor configured to provide electrical power to the motor contained in the toy body such that the motor provides power for movement of the toy body components upon insertion or activation of the transferable power unit.

In some configurations, the present system can include various toy bodies configured with different appearances and functionality. However, preferably several or all toy bodies of the system are configured to receive and interact with the same power unit configuration. Some toy bodies may be configured to receive more than one power unit and utilize more than one power unit in the operation of the toy body. Some toy bodies may be configured to be combined together to create a larger toy body, wherein a multitude of power units may be inserted to operate the larger combined toy body. In some embodiments, the power unit may be configured to have the appearance of a toy figure such that when the power unit is placed into a toy body such as a toy car, the toy figure can be seen to be operating or driving the toy car. In other embodiments, the power unit may be configured to have the appearance of, and represent, an engine or motor of the toy or other vital component which may cause the toy body to move, such as a gas tank, battery, or other power source canister.

In other embodiments, the toy bodies may be configured such that the power unit does not propel the toy body, but instead creates movement or other activation of a component of the toy body which remains stationary. For example, the toy body may include a ferris wheel with a void configured to receive a power unit. When a power unit is inserted into the void of the ferris wheel and the power unit is activated as discussed above, the motor of the power unit may create movement in the rotation of the ferris wheel.

FIG. 1 illustrates an embodiment of a power unit 10 of the present toy or system of toys. The illustrated embodiment of the power unit 10 preferably includes a motor 11 encapsulated within the body of the power unit 10. The power unit 10 may include a drive gear arrangement 12 operably connected to the motor such that the rotational force generated by the motor 11 results in rotation of the drive gear 12. The drive gear 12 may include at least one drive gear portion or element, such as a worm gear portion 20, configured to provide rotational force to at least one driven gear element. Preferably, the drive gear 12 includes multiple drive portions, which can interact with multiple driven elements. Preferably, the multiple drive portions are different from one another and each portion can interact with a different type of driven element than the other drive portion(s). For example, in the illustrated embodiment, the drive gear 12 comprises a worm gear portion 20, wherein the motor 11 rotates the drive gear 12 about a lengthwise axis of the worm gear 20.

In some embodiments, the drive gear 12 may include more than one drive gear component or portion positioned on substantially the same drive shaft or along the same drive axis and being driven by the same motor 11. For example, the drive gear depicted in FIG. 1 includes the worm gear portion 20, as described, which is configured to provide rotational power to a driven member, such as a driven spur gear, for example, about a first rotational axis. The drive gear 12 further includes a first spur gear portion 22 located, for example, on the upper portion of the drive gear 12 and configured to provide rotational power to another driven member, such as a driven spur gear, for example, which is rotatable about a second rotational axis. In some configurations, the second rotational axis is substantially perpendicular to the first rotational axis. In some configurations, the drive gear 12 may further include a second spur gear (not pictured) positioned on the lower portion of the drive gear for providing rotational power to an additional driven spur gear included in the toy body.

In the embodiment depicted in FIG. 1, the lower portion of the drive gear 12, for example, includes a male drive coupling 24 configured to provide rotational power to, for example, a driven socket rotatable about a third rotational axis. In some configurations, the third rotational axis is substantially parallel with the second rotational axis described above and can be coaxial with the longitudinal axis of the worm gear 20. The male drive coupling 24 may be configured with a specific shape or key configuration (e.g., triangular, square, hex, star, slotted or cross) such that only certain female coupling socket configurations are able to receive the male drive coupling. In other configurations, this arrangement can be reversed and the drive gear 12 can include a female drive component configured to engage a male driven component. In another embodiment, the portion 24 of the drive gear 12 may be another form of gear, such as a spur gear, helical gear, or bevel gear, for example, where the body of the power unit is configured such that the teeth of the drive gear is available to an external driven gear component.

Thus, the embodiment of the power unit 10 depicted in FIG. 1 is configured to provide multiple (e.g., three) points of rotational force transfer to corresponding driven elements (e.g., driven gears or driven sockets) of a toy body. This allows for multiple components of the toy body with different axes of rotation or ranges of motion to be powered by a single power unit 10 containing a single drive mechanism (e.g., driveshaft) incorporating multiple points of drive transfer. For example, the drive worm gear 20 may be configured to rotate the wheels of a toy body configured in the shape of a car. A drive spur gear 22 located on the upper portion of the drive gear 12 may be configured to rotate a component of the toy car, such as a police siren located on top of the toy car. A drive male coupling 24 located on the lower portion of the drive gear 12 may be configured to rotate or move certain toy weapons included on the toy car. This configuration may use one motor 11 to provide multiple points of drive transfer, thereby reducing the complexity and cost of the power unit 10, while providing multifunctional drive power to various components of a toy body. In other embodiments, the power unit 10 may include a drive mechanism which includes a multitude of separate drive gears, also allowing for a multitude of drive transfer points of rotational force from the power unit 10 to the various components of the toy body. As described below, the system can utilize less than the available number of drive transfer portions of the drive gear 12, which can be one or more drive transfer portions.

The power unit 10 can include a power source, such as a battery 14, for example, and, in some arrangements, a controller 16. The battery 14 is coupled to the motor 11 to provide power for rotation of the motor 11. The controller 16, if present, can be coupled to the battery 14 and/or the motor 11 to control the operation of the battery 14 or motor 11, or possibly portions of the toy body with which the power unit 10 is associated or into which the power unit 10 is installed. The battery 14 and/or controller 16 can be connected to electrical contacts 18 by suitable electrical conduits (e.g., wires) 19 to permit electrical connection between the power unit 10 and another component, such as a toy body or charger. Thus, the power unit 10 preferably can communicate with a toy body electronically, in addition to providing drive power via the drive gear 12. Preferably, in addition, the power unit 10 can communicate with a charging device to recharge the battery 11 or other power source.

Figure 2:
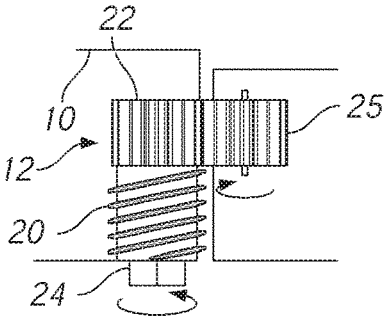
FIG. 2 is a partial view of a drive gear of the power unit of FIG. 1 engaged with a first type of drive portion of a corresponding toy body.
Figure 3:
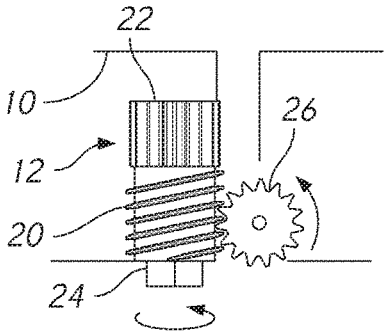
FIG. 3 is a partial view of a drive gear of the power unit of FIG. 1 engaged with a second type of drive portion of a corresponding toy body.
Figure 4:
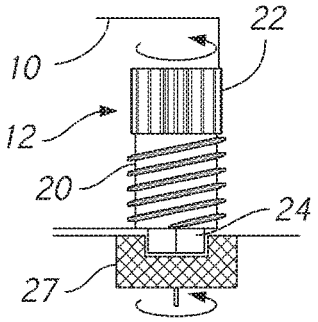
FIG. 4 is a partial view of a drive gear of the power unit of FIG. 1 engaged with a third type of drive portion of a corresponding toy body.

FIGS. 2-6 are schematic illustrations of the drive gear 12 of the power unit 10 engaged with various possible driven elements of an accessory, such as a toy body, for example. FIG. 2 illustrates the spur gear portion 22 of the drive gear 12 in driving engagement with a driven spur gear 25 of an accessory, such as a toy body, to drive the spur gear 25 for rotation about an axis that is substantially parallel to the axis of the drive gear 12, but preferably in an opposite rotational direction relative to the drive gear 12. FIG. 3 illustrates the worm gear portion 20 of the drive gear 12 in driving engagement with a driven spur gear 26 of an accessory, such as a toy body, to drive the spur gear 26 for rotation about an axis that is substantially perpendicular to the axis of the drive gear 12. The worm gear portion 20 can be configured to drive the driven spur gear 26 in either rotational direction. FIG. 4 illustrates the drive coupling portion 24 (e.g., male coupling) of the drive gear 12 in driving engagement with a driven coupling 27 (e.g., female coupling) of an accessory, such as a toy body, to drive the driven coupling 27 for rotation about an axis that is substantially coaxial with the axis of the drive gear 12, and preferably in the same rotational direction as the drive gear 12.

Figure 5:
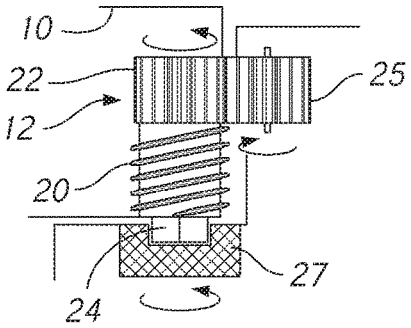
FIG. 5 is a partial view of a drive gear of the power unit of FIG. 1 engaged with two different types of drive portions of a corresponding toy body.
Figure 6:
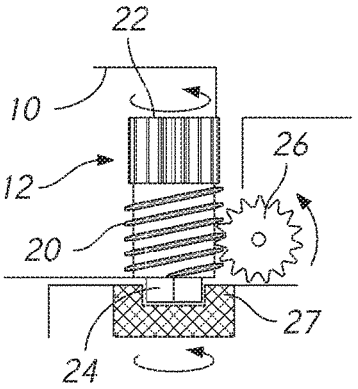
FIG. 6 is a partial view of a drive gear of the power unit of FIG. 1 engaged with two different types of drive portions, which are a different combination than that of FIG. 5, of a corresponding toy body.

As described above, the drive gear 12 can drive multiple driven components at once, including two, three or more driven components. For example, the drive gear 12 can drive at least as many components as portions 20, 22, 24 present on the drive gear 12. In some arrangements, one or more portions 20, 22, 24 can drive multiple driven components, such as driven gears positioned on opposite sides of the same drive portion 20, 22, 24, for example. FIGS. 5 and 6 illustrate examples of the drive gear 12 drivingly engaged with multiple driven components. For example, FIG. 5 illustrates the spur gear portion 22 of the drive gear 12 in driving engagement with a driven spur gear 25 and the drive coupling portion 24 (e.g., male coupling) of the drive gear 12 in driving engagement with a driven coupling 27 (e.g., female coupling) of an accessory, such as a toy body. FIG. 6 illustrates the worm gear portion 20 of the drive gear 12 in driving engagement with a driven spur gear 26 and the drive coupling portion 24 (e.g., male coupling) of the drive gear 12 in driving engagement with a driven coupling 27 (e.g., female coupling) of an accessory, such as a toy body. As described, any or all of the portions 20, 22, 24 can be in driving engagement with one or more driven members at any time.

Figure 7:
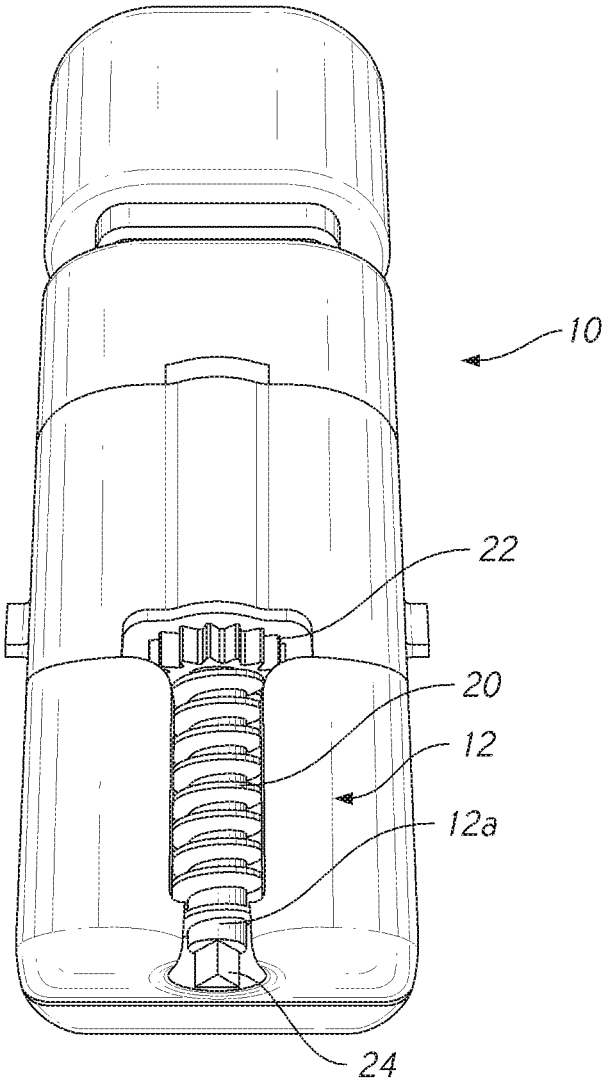
FIG. 7 illustrates an alternative embodiment of a power unit.
Figure 8:
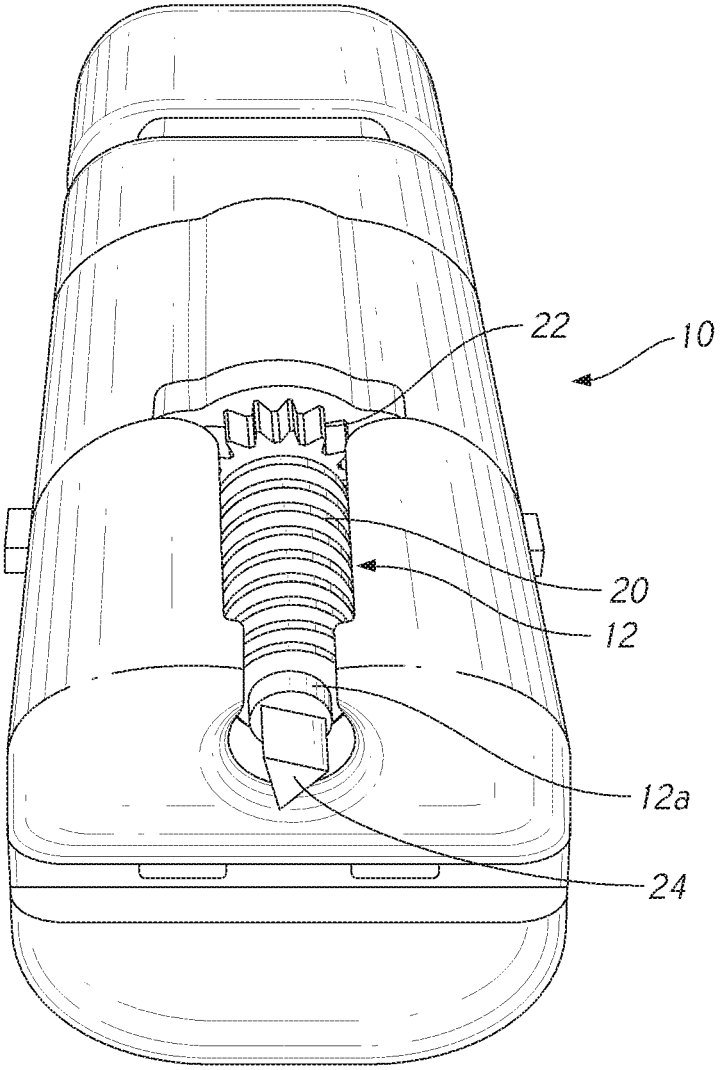
FIG. 8 is another view of the power unit of FIG. 7.

FIGS. 7 and 8 illustrate a modification of the power unit 10 of FIGS. 1-6. The power unit 10 of FIGS. 7 and 8 preferably is similar to the power unit 10 of FIGS. 1-6 except one portion (e.g., the worm gear portion 20) of the drive gear 12 occupies a greater length of the drive gear 12 or is proportionally longer than one or both of the other portions (e.g., spur gear portion 22 and drive coupling portion 24). For example, the worm gear portion 20 can be between about 2-5 times longer than one or both of the spur gear portion 22 and drive coupling portion 24, or any specific value within this range. In addition, the drive gear 12 can have a portion 12*a* between, for example, the worm gear portion 20 and the drive coupling portion 24 that is rotatably supported by a body of the power unit 10. Advantageously, such an arrangement provides support to a portion 12*a* of the drive gear 12 that is spaced from the end coupled to the motor 11 to reduce or limit off-axis or radial movement of the drive gear 12. In other respects, the power unit 10 can be assumed to be the same as or similar to the power unit 10 of FIGS. 1-6, or can be of another suitable arrangement.

Figure 9:
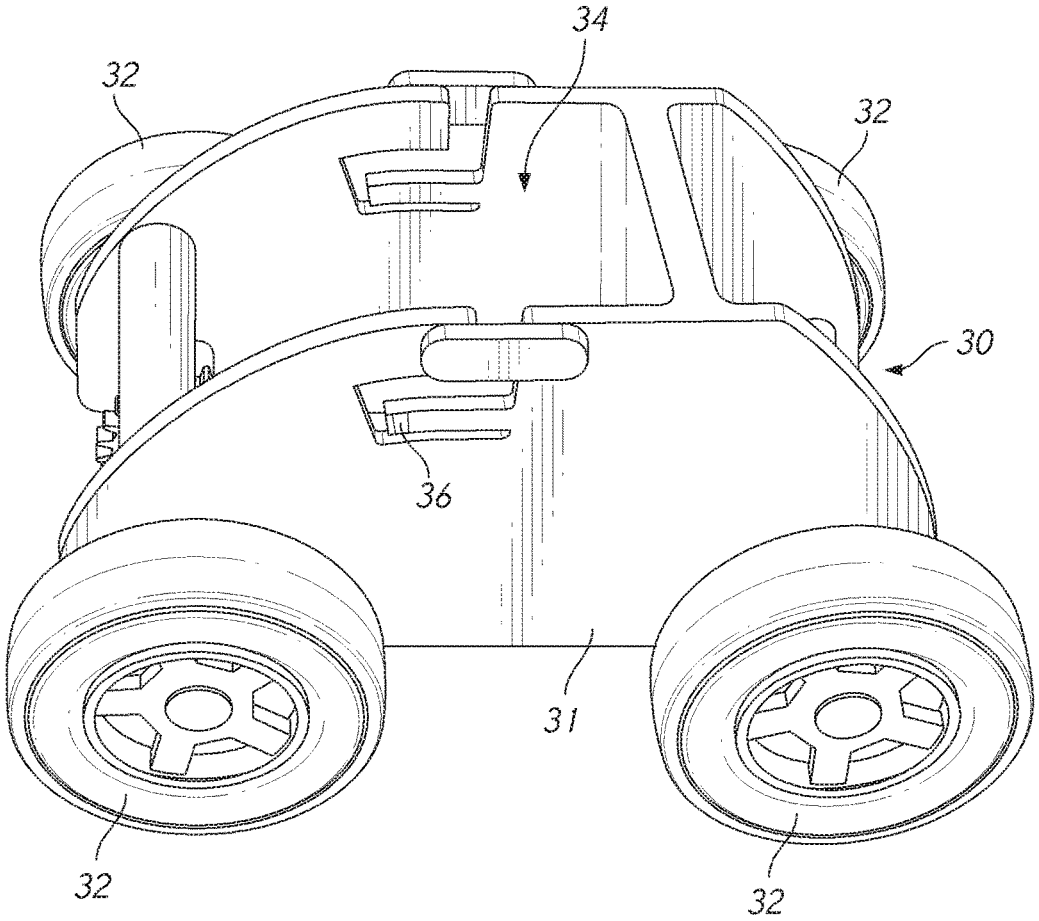
FIG. 9 is a side view of a vehicle toy body that is configured to receive the power unit of FIG. 7.

FIG. 9 is an image of an embodiment of a toy body 30 in the form of a toy car. The toy car may be configured to have any of the components that a traditional children's toy may include. In this example, the toy body includes a car body 31, four wheels 32, and wheel axles connecting the wheels for allowing movement of the car. An embodiment of the toy body may include a void 34 configured to receive and secure a power unit within the toy body. The void 34 may include a locking mechanism 36 to interact with the power unit 10 (e.g., in a snap lock fashion or engaging a circumferential or other slot in the power unit 10) to secure the power unit in place within the void 34 once the power unit is inserted by the user. In this embodiment, a driven gear may be mounted about one of the axles connecting two of the wheels of the toy car. The void 34 of the toy body 30 may be configured such that upon insertion of a power unit into the void 34, the drive gear of the power unit and the driven gear of the toy body become operably engaged. The power unit may then be activated so that a rotational force created by the motor of the power unit is transferred from the drive gear to the driven gear, and from the driven gear to the wheel axle, thereby creating a rotational force upon the axle and attached wheels, resulting in the toy body being propelled in a forward direction.

Figure 10:
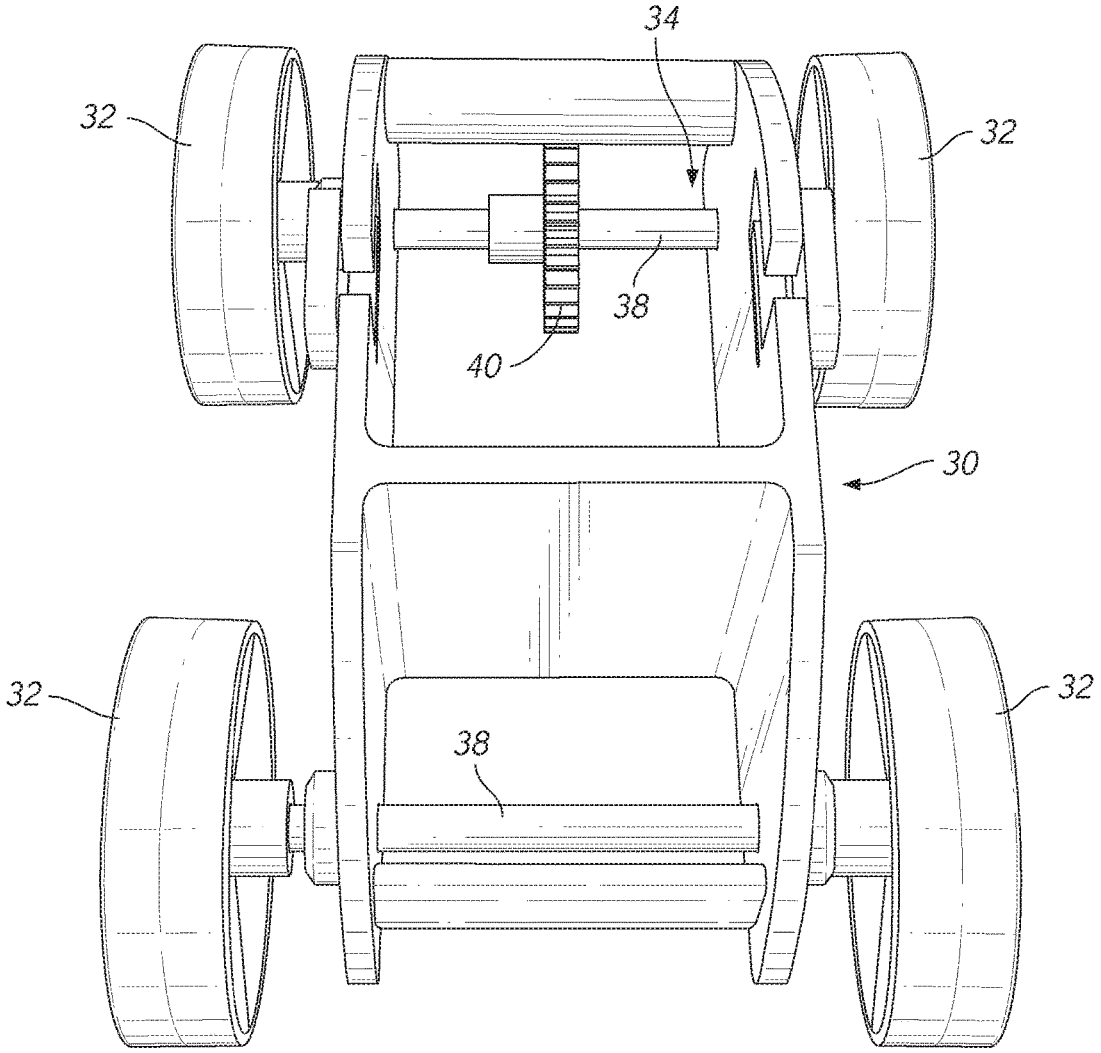
FIG. 10 is a top view of the vehicle toy body of FIG. 9.

FIG. 10 is a top view of the toy body 30, which illustrates the four wheels 32 connected by at least two axles 38 are shown in addition to the void 34 of the toy body 30 which is configured to receive and secure a power unit. In addition, a driven gear 40 is shown mounted to one of the at least two axles 38 connecting the wheels of the toy body 30. The driven gear 40 is mounted such that a rotational force applied to the driven gear (e.g., via the drive gear 12 of the power unit 10) results in a rotational force upon the axle, and in turn applies the rotational force upon the wheels attached to said axle.

Figure 11:
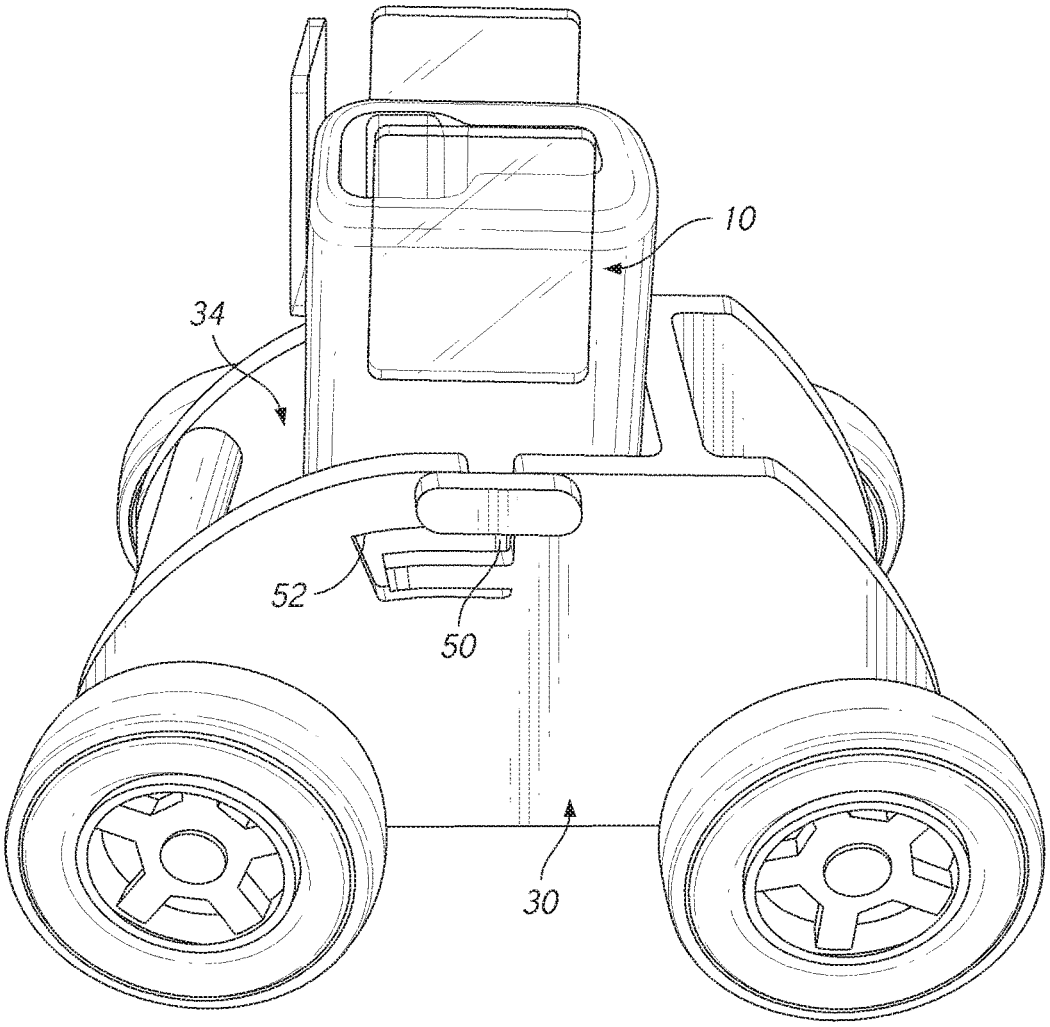
FIG. 11 is a side view of the vehicle toy body of FIG. 9 with the power unit of FIG. 7 inserted in a first position.

FIG. 11 depicts the power unit 10 and toy body 30 in an arrangement in which the power unit 10 has been inserted into the toy body 30. An embodiment of the toy body 30 may be configured such that the power unit 10 is allowed to be inserted into the toy body in only one predetermined alignment. For example, in the embodiment depicted in FIG. 11, the power unit 10 includes an elongated body encapsulating at least one motor, battery, gears, and, possibly, other components. The power unit 10 may be configured to be inserted into the void 34 of the toy body 30 in only one predetermined direction, and only one rotational alignment. This may be accomplished by corresponding notches and slots on the power unit 10 and toy body 30 configured to align with each other only when the power unit 10 is inserted in a particular predetermined alignment. In other embodiments the toy body 30 and power unit 10 may be configured such that the power unit 10 may be inserted in any alignment or direction. The power unit 10 may be configured in a shape such that insertion of the power unit 10 into the void 34 of the toy body 30 is not dependent on any predetermined alignment or positioning. For example, the power unit 10 may comprise a substantially cube shape, spherical shape, parallelogram shape or other shape which allows multiple insertion configurations.

Figure 21:
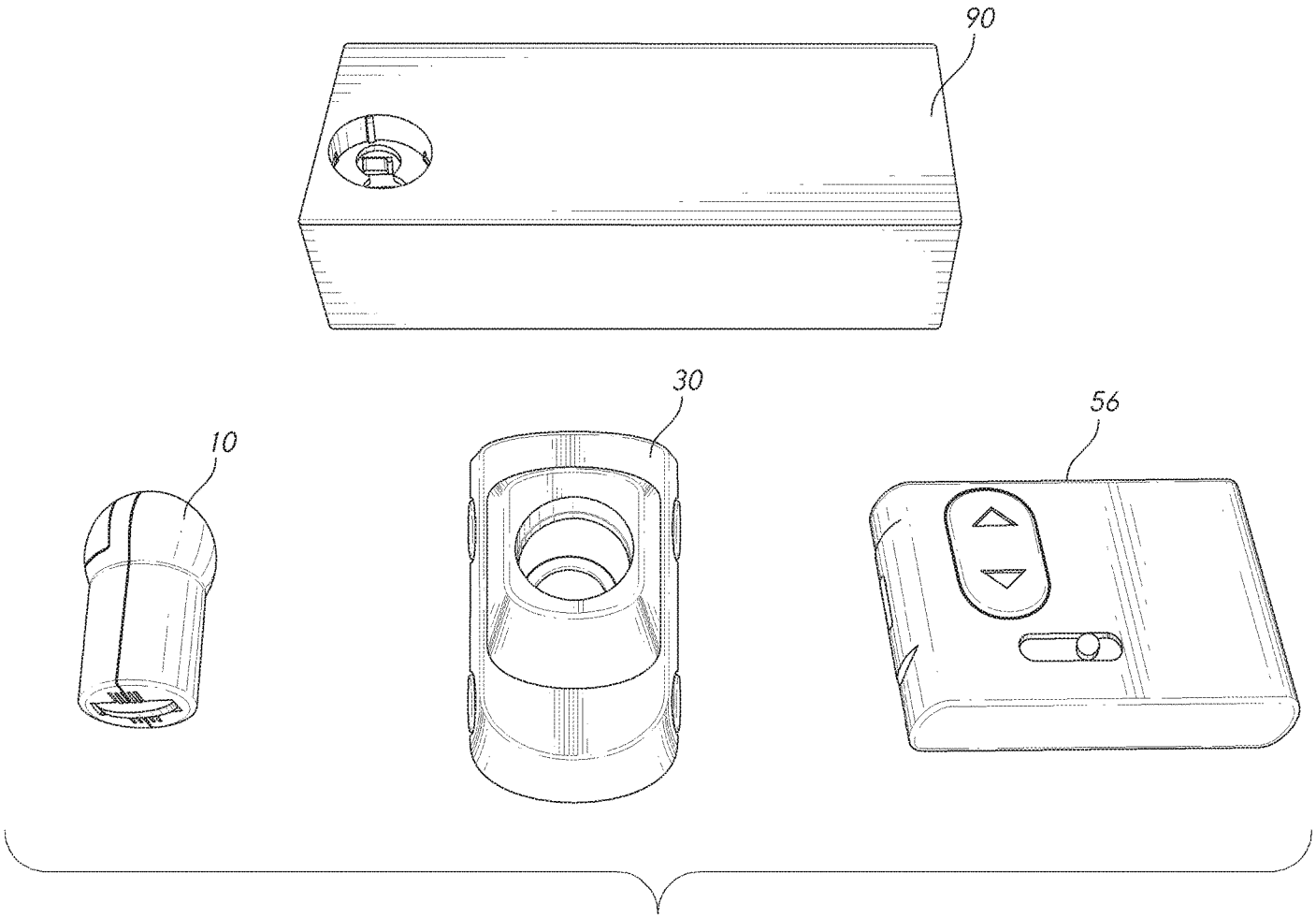
FIG. 21 illustrates optional components of a toy system, including a power unit, a toy body, a remote control and a charging station.

As described, the power unit 10 may be configured to include a small motor, battery, and at least one drive gear for transferring rotational power to an external driven gear. To activate the motor, the power unit 10 may include a switch or a dial accessible to the user, and preferably the switch or dial is accessible to the user even after the power unit 10 has been inserted and secured within the toy body 30. In one or more embodiments, the power unit 10 may be activated or otherwise controlled by remote control 56 by the user (see FIG. 21). In another embodiment, the toy body 30 may include a void 34 configured to receive a power unit 10 wherein the power unit 10 is placed in a first position upon insertion. In the first position, the drive gear of the power unit 10 is not in engagement with the at least one driven gear of the toy body 30. The void 34 of the toy body 30 is further configured to provide a second position to which the power unit can be moved from the first position by the user. In the second position, the drive gear of the power unit 10 becomes operably engaged with the at least one driven gear of the toy body 30.

In another embodiment, the power unit 10 is configured with a power switch for the motor such that moving the power unit 10 from the first position to the second position within the void 34 of the toy body 30 activates said switch of the power unit 10, turning on the motor 11. In this embodiment, the user is able to turn on the motor and engage the drive gear of the power unit with the driven gear of the toy body in one motion by moving the power unit from the first position to the second position within the void 34 of the toy body. Similarly, in an embodiment, the user is able to turn off the motor by returning the power unit to the first position from the second position within the void of the toy body. In some embodiments, the power switch is unavailable to the user, and can only be actuated by placing the power unit into the void of the toy body and moving the toy body from the first position to the second position.

Referring back to FIG. 11, a power unit 10 is depicted in the first position in the void of the toy body 30. In an embodiment, a notch 50 may be provided on the power unit 10 which may align or engage with a slot 52 provided on the toy body 30 such that the movement of the notch 50 along the slot 52 provides guidance for the movement of the power unit 10 from the first position to the second position. In the depicted embodiment, the power unit 10 is moved from the first position to the second position by the user moving the upper portion of the power unit 10 rearward toward or to a predetermined angle, which can correspond to the second position. In an embodiment, the power unit may be moved from the first position to the second position by moving the power unit 10 along a predetermined, limited path of travel; examples including sliding the power unit in a certain direction within the void, rotating the power unit within the void, or otherwise moving or manipulating the power unit such that it moves from a first disengaged position to the second engaged position.

Figure 12:
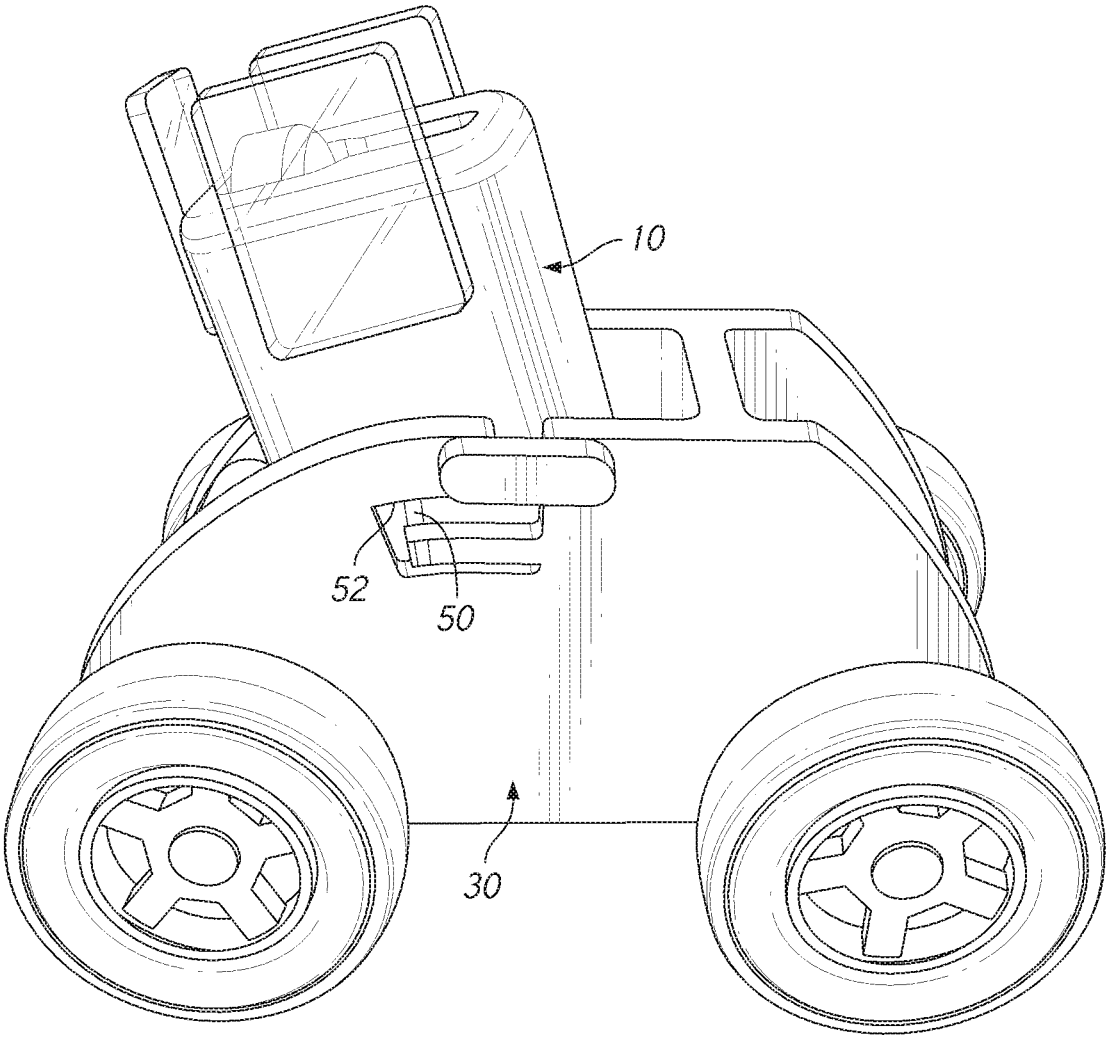
FIG. 12 is a side view of the vehicle toy body and power unit of FIG. 11 with the power unit in a second position.

Turning now to FIG. 12, the power unit 10 and toy body 30 of FIG. 11 are depicted, wherein the power unit 10 has been moved from the first position (as in FIG. 11) to the second position. The toy body 30 and power unit 10 may be configured such that the drive gear of the power unit 10 and the driven gear of the toy body 30 become operably engaged when the power unit 10 is moved to the second position. In this embodiment, the drive worm gear of the power unit 10 is operably engaged with the driven spur gear mounted about the rear axle of the toy body 30. Once the motor of the power unit 10 is turned on, this configuration will result in the motor of the power unit 10 transferring rotational power to the rear wheels of the toy body 30, allowing for propulsion of the toy.

In another embodiment, the void of the toy body 30 may be configured to have a third position for the placement of the power unit 10. In such an embodiment, the power unit 10 may be moved to the third position by moving it from the first position in a direction opposite the direction of the second position. The toy body 30 and power unit 10 may be configured such that the toy body is propelled in a first direction when the power unit is moved to the second position, and the toy body may be further configured such that the toy body is propelled in a second direction opposite the first direction if the power unit is moved to the third position. In another preferred embodiment, the toy body 30 may be configured to move in a different direction or manner altogether if the power unit 10 is moved to the third position instead of the second position. In some embodiments, the void 34 may be configured to have a multitude of positions for the placement of the power unit 10, the movement of the power unit to each position resulting in propulsion of the toy body in a different direction. In another embodiment, each position for the placement of the power unit determines a different movement or range of motion of various components of the toy body.

Figure 13:
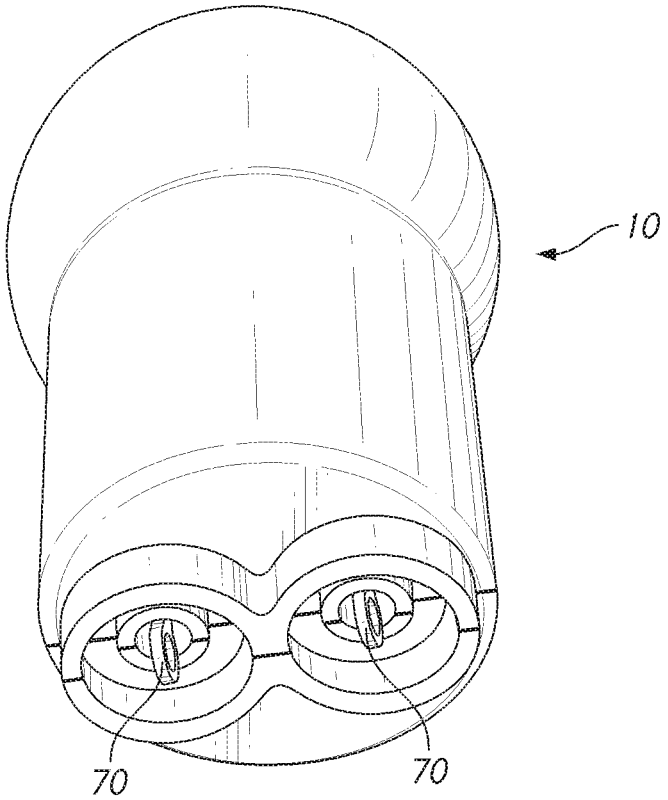
FIG. 13 illustrates another embodiment of a power unit.

FIG. 13 depicts another embodiment of a power unit 10. In this embodiment, the power unit 10 includes a capacitor (not pictured) configured to hold a charge of electricity sufficient to provide temporary power to a small motor. The power unit 10 may be configured to be inserted into a toy body having a void configured to receive said power unit. The power unit may further include two electrical leads 70 configured to transfer electrical power to two corresponding receiving electrical leads within the toy body. In another embodiment, the power unit may include a small rechargeable battery instead of a capacitor. As discussed previously, the power unit 10 may include a switch or a dial to turn on and turn off the transfer of electrical power to the toy body. Another embodiment may include a configuration as discussed previously wherein the power transfer is turned on when the power unit is moved from a first position to a second position within the void of the toy body.

Figure 14:
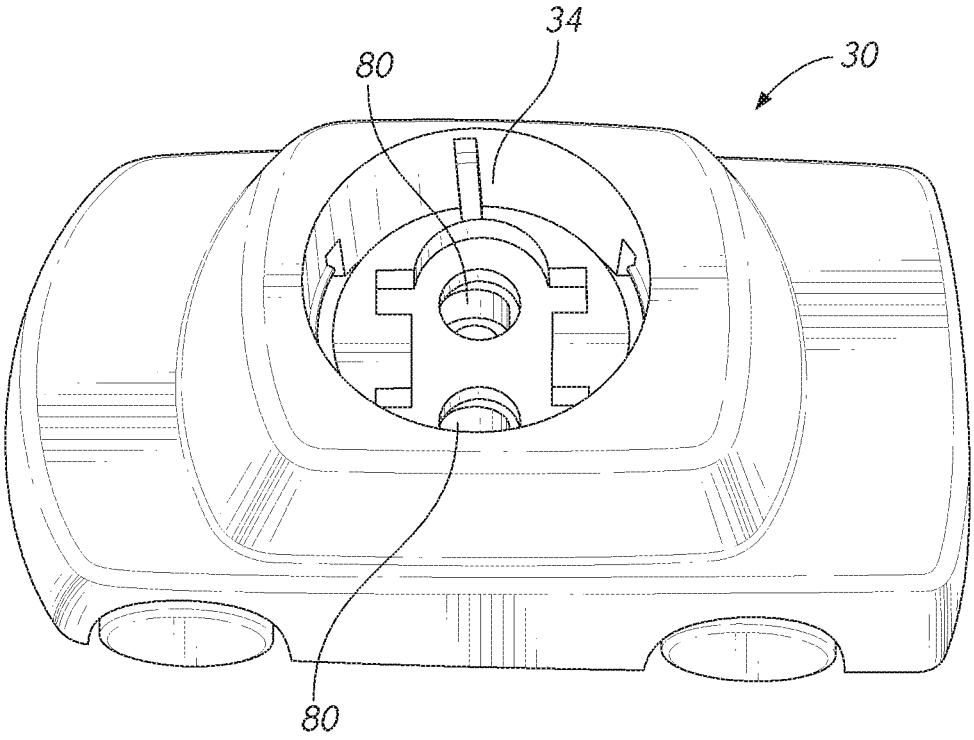
FIG. 14 is a top view of a vehicle toy body configured to accept the power unit of FIG. 13.

FIG. 14 depicts an embodiment of a toy body 30 configured to be compatible with the power unit 10 discussed above in FIG. 13. An embodiment of the toy body 30 may be configured as previously discussed, having any of the parts and components of a traditional children's toy, such as a toy car. An embodiment of the toy body 30 may further include a small motor configured to provide rotational power to various components of the toy body, said toy body including a void configured to receive a power unit 10, such as the embodiment depicted in FIG. 13. The void 34 of the toy body 30 may further include two receiving electrical leads 80 configured to come into electrical contact with the electrical leads of the power unit when a user inserts the power unit into the void 34 of the toy body 30. When the leads of the power unit and the leads 80 of the toy body are electrically connected, the charge held in the capacitor of the power unit is discharged and electrical power is transferred to the motor of the toy body 30. The void 34 of the toy body 30 may be configured with an asymmetrical shape, or include an asymmetrical notch 82 or pattern, and the power unit may also be configured with a matching asymmetrical shape or slot corresponding to the notch 82 or pattern of the void, such that the power unit 10 can only be inserted into the void 34 in a single predetermined alignment. This ensures correct alignment of the correct electrical leads 70 of the power unit with the corresponding electrical leads 80 of the toy body. In the embodiment depicted in FIG. 8, when a user inserts a power unit 10 into the void 34 of the toy body 30, electrical power is transferred from the power unit to the motor of the toy body, which in turn rotates the wheels of the toy body configured in the shape of a car, resulting in propulsion of the toy body.

Figure 15:
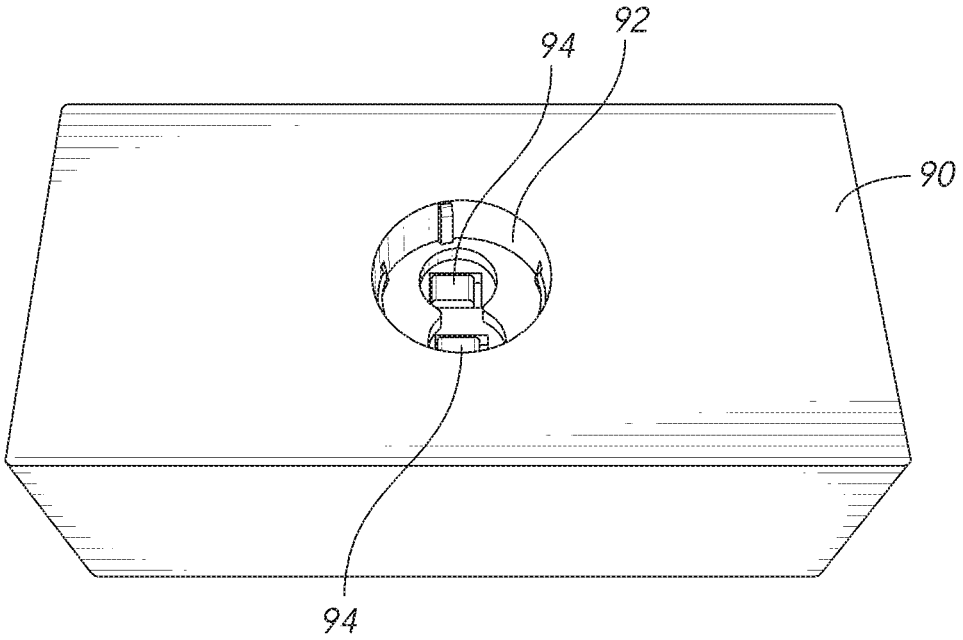
FIG. 15 illustrates a charging station for a power unit, such as the power unit of FIG. 13.

FIG. 15 shows a charging station 90 for the power unit 10, such as any of the power units 10 discussed. The charging station 90 may be configured to include at least one battery to provide electrical power to the power unit 10. The charging station 90 may include a void 92 configured to receive the power unit 10, said void 92 including two electrical leads 94 configured to align with the electrical leads (e.g., 18 or 70) of the power unit 10. The charging station 90 may be configured to provide electrical charge to the capacitor, battery or other power source of the power unit 10 when it is inserted into the void 92 of the charging station 90. The charging station 90 may provide electric power to the capacitor from the at least one battery. The charging station 90 may further be configured with a power cord to be plugged into an electrical socket to provide electrical charge to the capacitor of the power unit. Other suitable arrangements for the charging station 90 to have access to electrical power can also be used.

Figure 16:
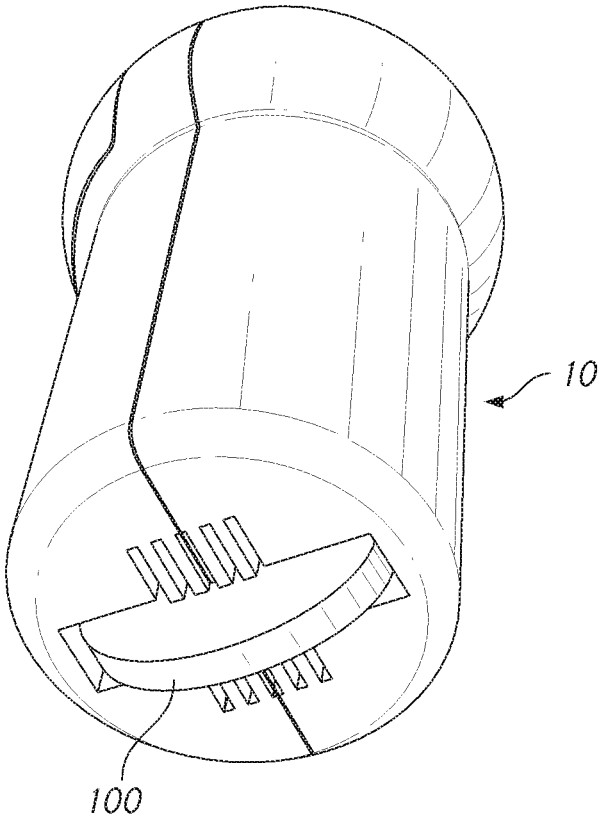
FIG. 16 illustrates another embodiment of a power unit that includes a drive element configured to directly contact a surface to provide motion to an associated toy body.

FIG. 16 depicts another embodiment of a power unit 10, which may include any or all of a battery, a motor, and gears within the body of the power unit. However, instead of or in addition to the motor providing power to a drive gear of the power unit which is thereafter transferred to components of the toy body, the power unit may include its own toy propulsion or toy movement mechanism, such as a wheel 100. The embodiment depicted in FIG. 16 includes a wheel 100 powered by a motor and battery, the lower portion of the wheel 100 positioned to protrude from the bottom surface of the power unit 10 such that the wheel 100 contacts a flat surface when the power unit 10 is placed substantially vertical on a flat surface. The power unit 10 may be configured to be inserted into a void of a toy body, and therein propel the toy body without the involvement of any components of the toy body. As discussed previously, the power unit 10 may include a switch or a dial to turn on and turn off the motor within the power unit. Another embodiment may include a configuration as discussed previously wherein the power to the motor is turned on when the power unit is moved from a first position to a second position within the void of the toy body.

Figure 17:
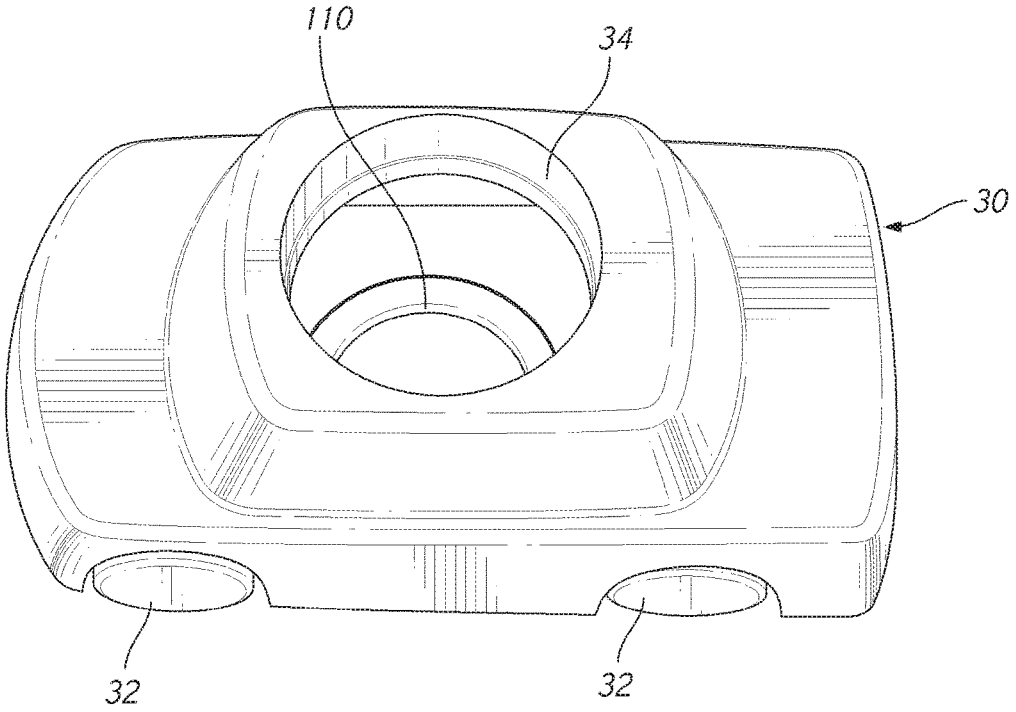
FIG. 17 illustrates a vehicle toy body configured to receive the power unit of FIG. 16.

FIG. 17 depicts an embodiment of a toy body 30 configured to be compatible with the power unit 10 discussed above in FIG. 16. The embodiment of the toy body 30 includes several components of a traditional toy car, such as wheels 32 and axles interconnecting said wheels. The embodiment may further include a void 34 configured to receive the power unit of FIG. 16, the void 34 including a lower opening 110 which provides direct communication between the void 34 and the surface below the toy body. The toy body 30 may be configured such that when the power unit 10 of FIG. 16 is inserted into the void 34 of the toy body 30, the wheel 100 of the power unit contacts the surface underneath the toy body such that when the motor of the power unit is turned on, the wheel 100 of the power unit rotates on the surface and provides propulsion to the toy body. In this configuration, no power is transferred to, and no propulsion is generated from, the traditional toy wheels 32 included in the toy body 30. The traditional toy wheels 32 of the toy body may be configured such that they are lifted off of the flat surface when the power unit 10 is inserted into the void 34 so as to minimize drag as the toy body is being propelled by the wheel 100 included in the power unit 10. Alternatively, the traditional toy wheels 32 of the toy body 30 may be configured to freely rotate in contact with the flat surface while the toy body 30 is being propelled by the rotational force of the wheel 100 included in the power unit. In an embodiment, the void 34 of the toy body 30 may be configured to allow insertion of the power unit 10 in any rotated alignment so that the user is able to control which direction the wheel 100 of the power unit 10 will be facing, which in turn determines the propulsion direction of the toy body.

Figure 18:
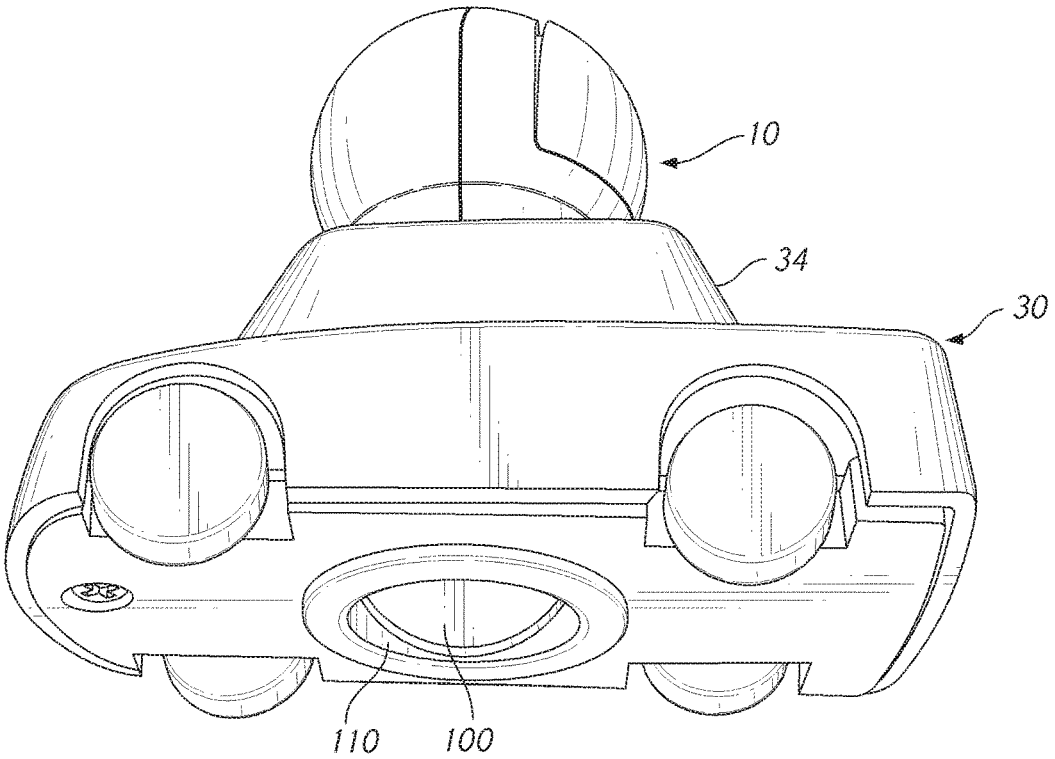
FIG. 18 illustrates a combination of the vehicle toy body of FIG. 17 and the power unit of FIG. 16.

FIG. 18 depicts the combination of a power unit 10 as discussed above in FIG. 16 and a toy body 30 as discussed above in FIG. 17 wherein the power unit is inserted into a void of the toy body. As discussed above, the power unit 10 includes a wheel 100 configured to provide rotational drive when placed in contact with a surface underneath the toy body 30. The power unit 10 is inserted into a void 34 of the toy body 30 which includes a lower opening 110 providing direct communication between the power unit and the flat surface underneath the toy body. The wheel 100 of the power unit 10 is positioned such that it is in direct contact with the flat surface when the power unit 10 is fully inserted into the void 34. The combination of the embodiments as depicted in FIG. 18 is configured to propel the toy body 30 by rotation of the wheel 100 of the power unit 10 upon turning on the motor of the power unit.

Figure 19:
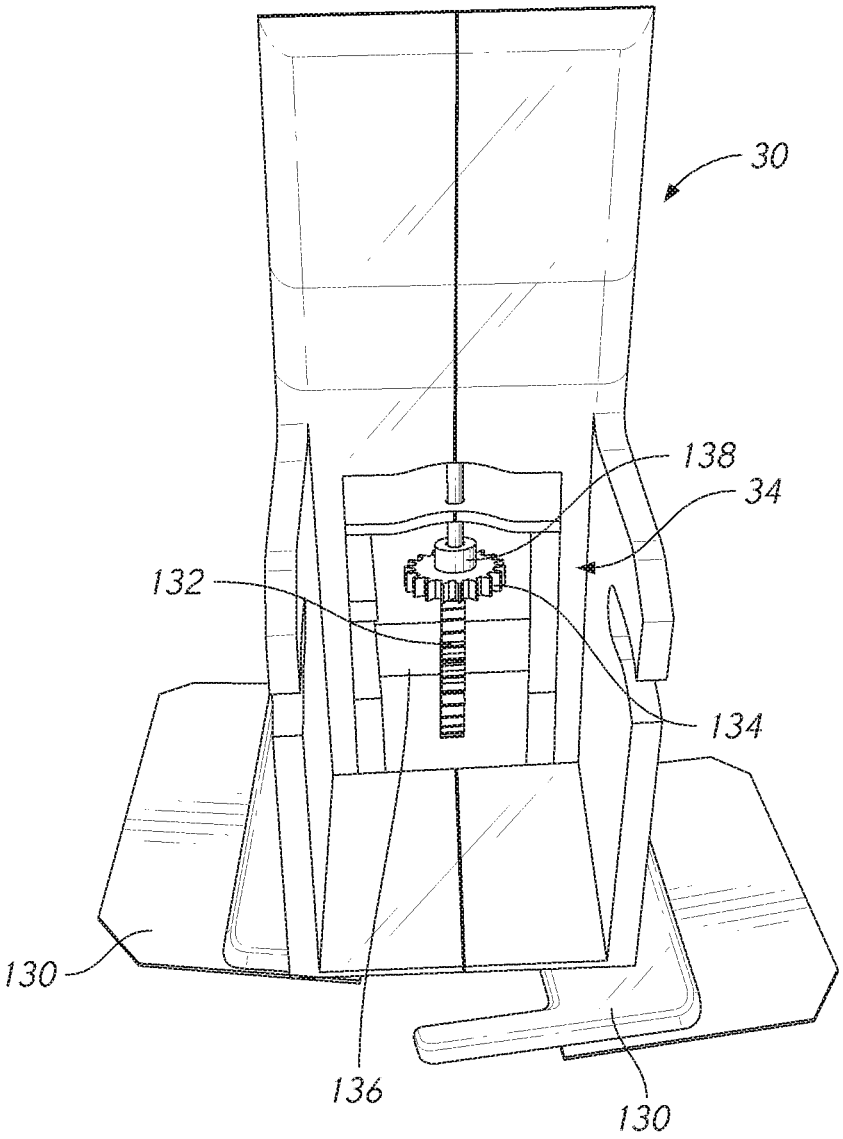
FIG. 19 illustrates a toy body in the form of a robot configured to receive a power unit.

FIG. 19 depicts an embodiment of a toy body 30 configured to be compatible with any of the power units 10 described herein. The toy body 30 of FIG. 19 is configured to resemble a toy robot with moving legs to move the toy robot forward on a flat surface. The toy body 30 includes two legs 130 which are configured to be moved in an alternating motion so as to create a walking motion of the robot. The toy body 30 includes a void 34 configured to receive and secure a power unit. The toy body 30 may also include at least one driven gear 22 configured to engage with the at least one drive gear of the power unit and receive rotational power from the drive gear of the power unit which is operably driven by the motor. The embodiment of the toy body 30 in FIG. 19 includes a first driven gear 132 configured to engage with the worm drive gear of the power unit discussed above in FIGS. 1-6. The first driven gear is mounted about a first driven shaft 136, which is configured to provide rotational power to alternately move the legs 130 of the robot toy body 30 to mimic a walking movement. The depicted embodiment further includes a second driven gear 134 configured to engage with the spur drive gear of the power unit discussed above in FIGS. 1-6. The second driven gear 134 is mounted about a second driven shaft 138 which may be operably coupled to other moveable components of the robot toy body 30 to create realistic movement.

Figure 20:
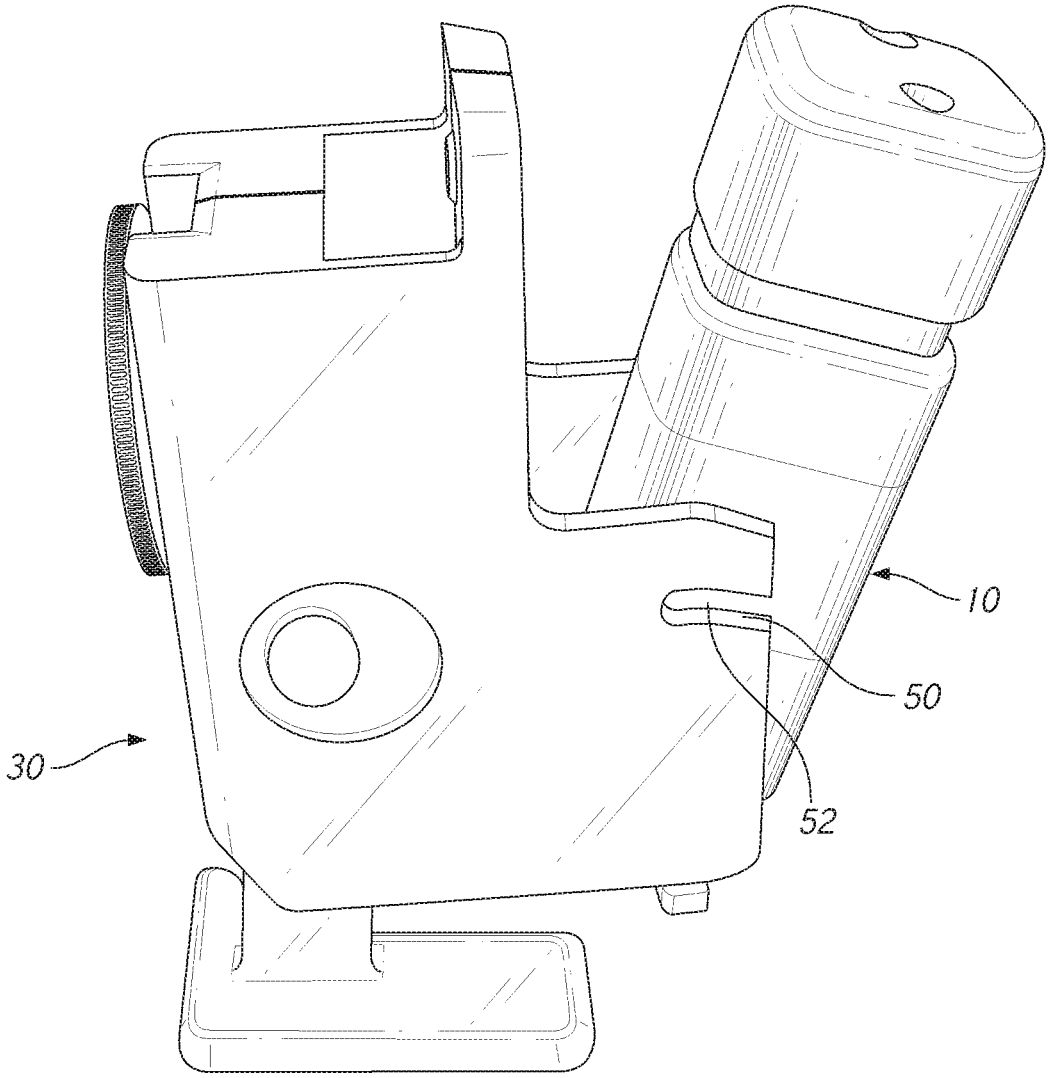
FIG. 20 illustrates the toy body of FIG. 19 with an associated power unit.

FIG. 20 depicts an alternate view of the embodiment of the toy body 30 discussed above in FIG. 19 with a power unit 10 inserted into the void of the toy body 30, where the power unit is in a disengaged position. As in the toy body 30 discussed above, the embodiment depicted in FIG. 20 includes a void which provides a first position for the power unit 10 in which the drive gears of the power unit are not in engagement with the driven gears of the toy body 30. The void may also provide a second position for the power unit 10 in which the drive gears of the power unit become engaged with the driven gears of the toy body 30 such that rotational power may be transferred by way of the engaged gears from the motor of the power unit to the moving components of the toy body. In an embodiment, a notch 50 may be provided on the power unit 10 which may align or engage with a slot 52 provided on the toy body 30 such that the movement of the notch 50 along the slot 52 provides guidance for the movement of the power unit 10 from the first position to the second position. In the depicted embodiment, the power unit 10 is moved from the first position to the second position by the user moving the upper portion of the power unit 10 rearward at a predetermined angle.

Additional types of toy bodies can be used with any of the power units 10 described herein. For example, one additional toy body can be in the form of a toy truck that can be similar to any of the other wheeled toy vehicles described herein. Another embodiment involves a multi-wheeled vehicle with the axles of the wheels being non-parallel with one another. Such a vehicle can exhibit a spinning motion upon driving of the wheels. Another embodiment involves a toy spinning top that can receive a power unit 10. The power unit 10 can apply power to the top to cause rotation of top about its own vertical axis. The top can have various, preferably interchangeable, tips that contact the surface on which the top is operated and which provide different characteristics to the movement of the top on the surface.

Figure 22:
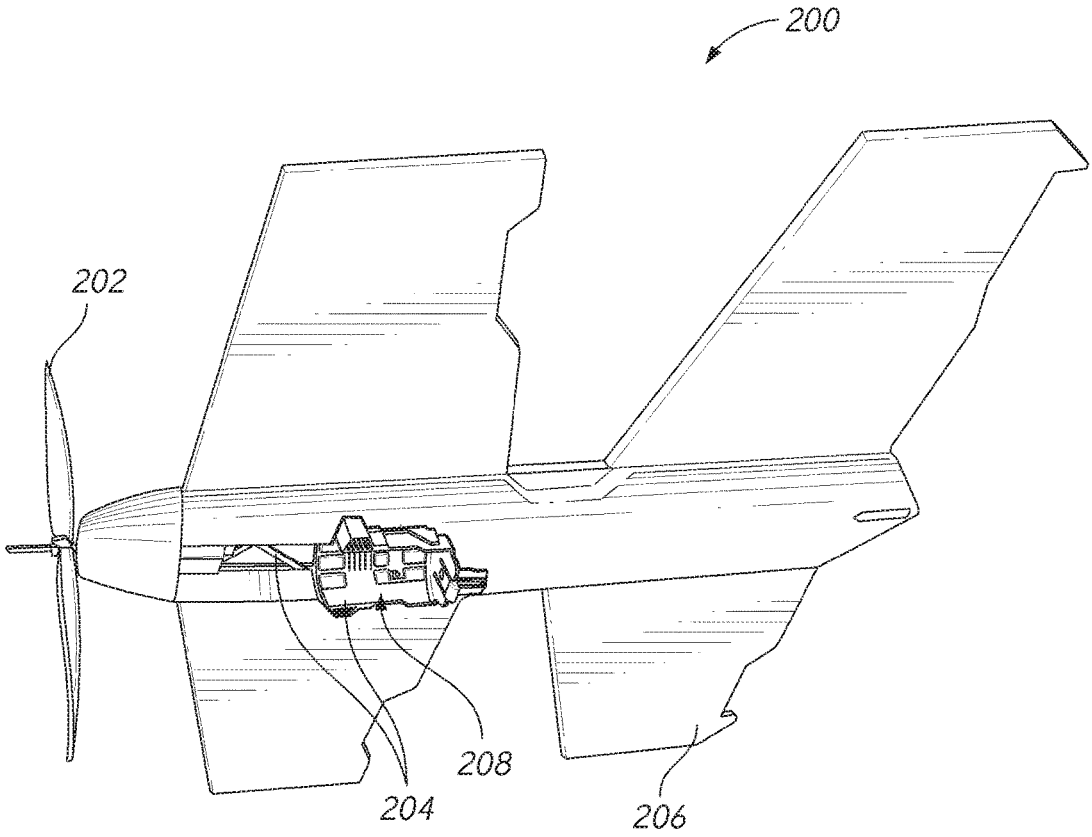
FIG. 22 illustrates a toy body in the form of a flying vehicle.
Figure 23:
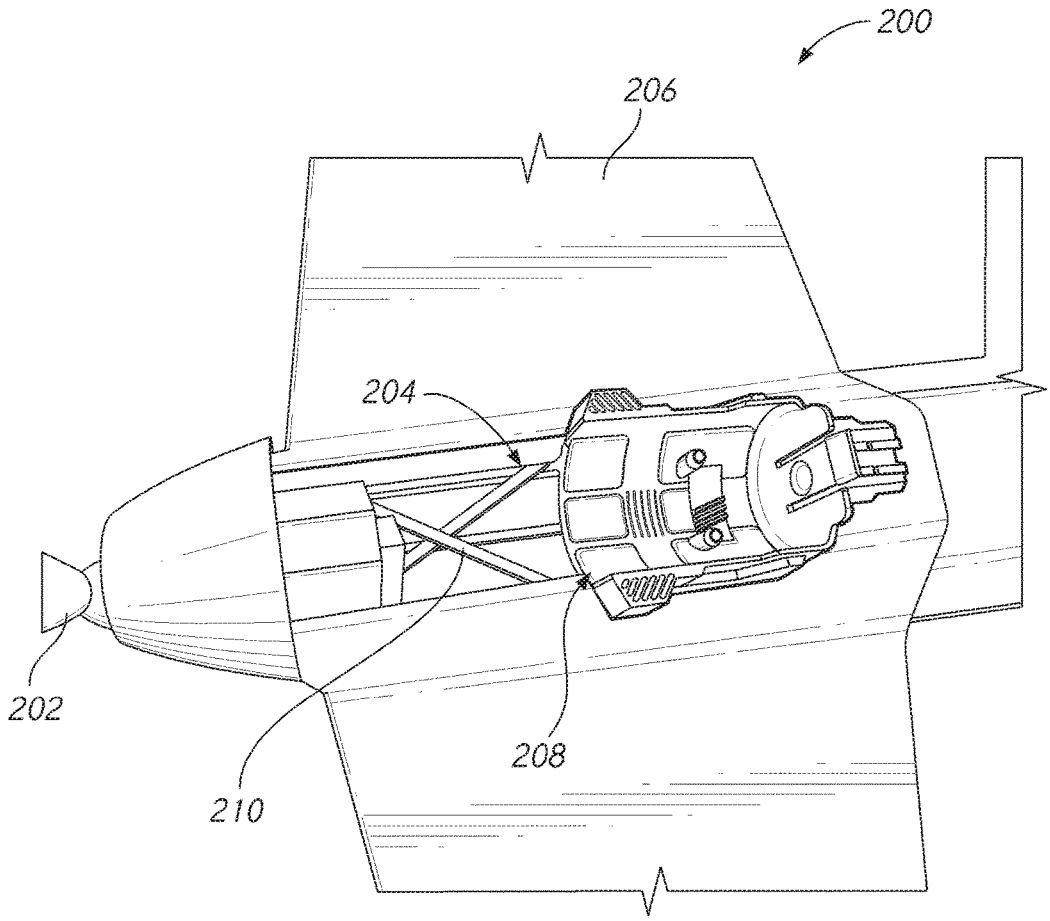
FIG. 23 is another view of the flying vehicle of FIG. 22.

FIGS. 22 and 23 illustrate another vehicle, such as a flying vehicle 200, for example, that can receive a power unit, such as any of the power units 10 disclosed herein. The flying vehicle 200 can have a propeller 202 that is powered by the power unit, such as via a transmission arrangement. Preferably, the flying vehicle 200 (e.g., airplane) has a first portion 204 or powertrain unit constructed from at least a first material, such as plastic, and a second portion 206 or body portion constructed from at least a second material. The powertrain unit 204 can include a space or void 208 for receiving the power unit and can be connected to and/or include the propeller 202 or other propulsion arrangement. In some configurations, the first portion or powertrain unit 204 includes a frame portion 210 that extends along a portion or an entirety of the body portion 206 and provides support to the body portion 206. The body portion 206 can be formed over the powertrain portion 204. For example, the body portion 206 can be constructed of a foam material (e.g., polystyrene foam or similar) that is rigid enough to hold a desired shape, but light enough that the vehicle 200 can fly under the power of the power unit and propeller 202 or other propulsion arrangement.

Conclusion

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A toy system, comprising:

a power unit comprising a body, a motor, a drive element driven by the motor, wherein the drive element comprises at least a first drive portion and at least a second drive portion positioned on a single drive shaft driven by the motor, the first drive portion spaced apart from the second drive portion;

wherein the power unit is insertable into a first toy body and a second toy body such that:

the drive element is configured to engage a first driven element of the first toy body and the power unit is configured to drive the first driven element, and the drive element is configured to engage a second driven element of the second toy body that is different from the first toy body and the power unit is configured to drive the second driven element, wherein the at least a first drive portion of the drive element is configured to be utilized during the engagement of the drive element with the first driven element and the second drive portion of the drive element is configured to be utilized during the engagement of the drive element with the second driven element.

2. The toy system of claim 1, wherein the drive element can drive different types of driven elements.

3. The toy system of claim 2, wherein the drive element comprises two or more of a spur gear portion, a worm gear portion and a drive coupling portion.

4. The toy system of claim 1, wherein the power unit further comprises a controller within the power unit body.

5. The toy system of claim 1, wherein the first toy body is one of a toy vehicle, a toy robot, and a toy spinning top, and wherein the second toy body is one of a toy vehicle, a toy robot, and a toy spinning top.

6. The toy system of claim 1, further comprising a flying vehicle comprising a propulsion arrangement driven by the power unit.

7. The toy system of claim 1, wherein the flying vehicle comprises a powertrain portion comprising the propulsion arrangement and a body portion, wherein the body portion comprises a foam material.

8. The toy system of claim 1, wherein the power unit further comprises a source of power within the power unit body.

9. The toy system of claim 1, wherein the toy system further comprises the first toy body and the second toy body.

10. A power unit for a toy body, comprising:

a power unit body;

a motor within the power unit body;

a drive gear that is rotationally driven by the motor, wherein the drive gear has at least two discrete drive portions spaced apart from each other and positioned on a single drive shaft driven by the motor that can drive different driven components, the at least two discrete drive portions comprising a first drive portion and a second drive portion; and a drive coupling portion configured to connect to a toy body, and an intermediate portion positioned between the first drive portion and the drive coupling portion, wherein the intermediate portion is at least partially supported by the power unit body.

11. The power unit of claim 10, wherein the drive gear further comprises a slot.

12. The power unit of claim 11, wherein one or more of the first drive portion or the second drive portion is positioned within the slot and is visible through at least one end of the slot.

13. The power unit of claim 10, wherein the first drive portion includes a worm gear portion.

* * * * *